US006041965A

United States Patent [19]

Smith

[11] Patent Number: 6,041,965

[45] Date of Patent: Mar. 28, 2000

[54] MULTI-FUEL DISPENSING SYSTEM AND METHOD

[75] Inventor: Richard Smith, Salisbury, Md.

[73] Assignee: Dresser Industries, Inc., Dallas, Tex.

[21] Appl. No.: 09/213,306

[22] Filed: Dec. 16, 1998

[51] Int. Cl.[7] ..... B67B 7/00

[52] U.S. Cl. ..... 222/25; 222/1; 222/144.5; 141/9; 141/104; 141/248

[58] Field of Search ..... 222/25, 26, 1, 222/144.5; 141/9, 104, 248; 137/111, 112, 516.25

[56] References Cited

U.S. PATENT DOCUMENTS

| | | | |
|---|---|---|---|
| 791,666 | 6/1905 | Wishart | 137/112 |
| 2,044,921 | 6/1936 | Swanland | 137/112 |
| 2,356,200 | 8/1944 | Bedard | 222/25 |
| 2,719,536 | 10/1955 | Stone . | |
| 2,731,171 | 1/1956 | Mankin et al. | 222/26 |
| 3,610,698 | 10/1971 | Gachot et al. . | |
| 3,828,806 | 8/1974 | Glos, II | 137/111 |
| 4,690,165 | 9/1987 | Leytes et al. . | |

*Primary Examiner*—J. Casimer Jacyna
*Attorney, Agent, or Firm*—Haynes and Boone, L.L.P.

[57] ABSTRACT

A dispensing system and method for two different fuels having different octane ratings respectively stored in two storage tanks, according to which a flow line extends from each tank to a chamber for receiving each fuel from its corresponding tank. A conduit extends from the chamber to a system for passing fuel from the chamber to the system for dispensing; and a valve is provided in the chamber for selectively blocking flow of the non-selected fuel into the chamber while permitting flow of the selected fuel into the chamber for passage, via the conduit, to the system. The valve eliminates any flow of the non-elected fuel into the chamber caused by the flow of the selected fuel.

4 Claims, 2 Drawing Sheets

MULTI-FUEL DISPENSING SYSTEM AND METHOD

BACKGROUND OF THE INVENTION

This invention relates to a fuel dispensing system and method and, more particularly, to such a system and method in which two grades of fuel are adapted to be dispensed both individually and in a blended form.

Many gasoline service stations require the installation of multi-product fuel dispensers or pumps, each for dispensing a plurality of fuel products having different octane ratings at each fueling station. Several known systems of this type typically include a flow path for each fuel product from its storage tank to the outlet nozzle which dispenses it into the consumer's vehicle, and a valve disposed in the flow path for selecting the fuel to be dispensed.

There are problems associated with these types of delivery systems. For example, when the customer chooses a particular grade of fuel, the flow of the latter fuel through the system can cause an undesirable amount of mixing with the non-selected grade, especially if the latter was the last product to be dispensed. A major cause of this is that the end product being dispensed through its conduit will tend to either siphon or force the other product from its conduit and through the valve, depending on the particular arrangement of the dispenser. This, of course, results in an undesirable mixing of the products, resulting in a product being dispensed which does not have an octane rating that is selected by the customer.

Therefore, what is needed is a system and method for dispensing two or more discrete fuel products according to which the discrete fuels can be dispensed individually without the danger of being mixed with, and therefore contaminated by, the other fuel. This has the major advantage of assuring that the octane rating of the dispensed product corresponds to that selected by the customer.

SUMMARY OF THE INVENTION

A dispensing system and method is provided for processing two different fuels having different octane ratings respectively stored in two storage tanks. A flow line extends from each tank to a chamber for receiving each fuel from its corresponding tank, and a conduit extends from the chamber to a dispenser for passing fuel from the chamber to the dispenser for dispensing. A valve is provided in the chamber for selectively blocking flow of the non-selected fuel into the chamber while permitting flow of the selected fuel through the chamber for passage, via the conduit, to the dispenser. The valve eliminates the flow of the selected fuel from inducing corresponding flow of the non-selected fuel into the chamber.

This has the advantage of eliminating any syphoning or forcing of the non-selected fuel into the flow path and thus eliminates any unintentional mixing of the two fuels. Thus, the fuels that are dispensed are extremely accurate with respect to their respective octane ratings.

DESCRIPTION OF THE PREFERRED EMNBODIMENT

Figure 1:
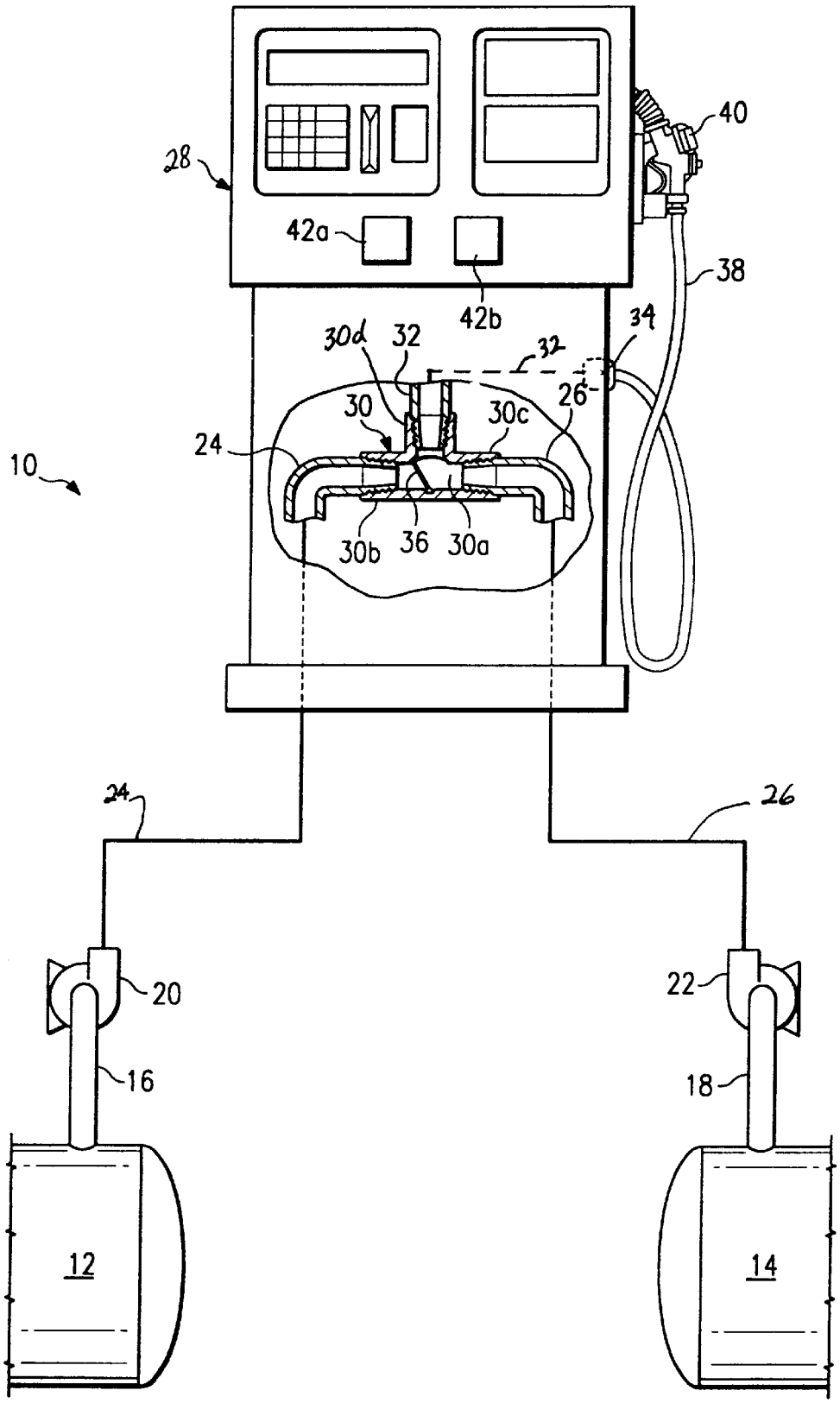
FIG. 1 is a schematic view, shown partially in section and in elevation, of the system of the present invention.

Referring to the drawing, a multi-product fuel dispensing system of the present invention is generally referred to by the reference numeral 10. The system 10 includes two storage tanks 12 and 14, which respectively store a relatively low-grade fuel and a relatively high-grade fuel, as determined by their respective octane ratings. Two fuel delivery lines, or conduits, 16 and 18 extend from the tanks 12 and 14, respectively and to the inlets of two fluid pumps 20 and 22, respectively.

Two additional conduits 24 and 26, each shown partially schematically and partially in section, extend from the respective outlets of the pumps 20 and 22 and into the interior of a fuel dispensing unit 28. A "tee" connector 30 is mounted in the unit 28 in any conventional manner and includes a center chamber 30*a* and two coaxially extending, inlet sections 30*b* and 30*c* which are respectively connected to the corresponding end portions of the conduits 24 and 26 and which communicate with the chamber 30*a*. The tee connector 30 also has an outlet section 30*d* communicating with the chamber 30*a* and extending perpendicular to the inlet sections 30*b* and 30*c*.

One end portion of a conduit 32 is connected to the outlet section 30*d* of the connector 30, and the other end of the conduit is connected to a fixture 34 extending though a wall of the unit 28.

It is understood that the corresponding end portions of the sections 30*b*–30*d* and their respective conduits 24, 26 and 32 are provided with corresponding threads to permit the above connections, it being understood that the connections between the pump 20 and its corresponding conduits 16 and 24, and between the pump 22 and its corresponding conduits 18 and 26, can be made in the same manner.

A valve member 36 is pivotally mounted to the body of the connector 30 for pivotal movement in the chamber 30*a*, and is in the form of a circular plate, or disc, having a diameter slightly greater than that of the inlet sections 30*b* and 30*c* Since this mounting of the valve member 36 to the body of the connector 30 can be done in any conventional manner, it will not be described in detail.

Figure 2A:
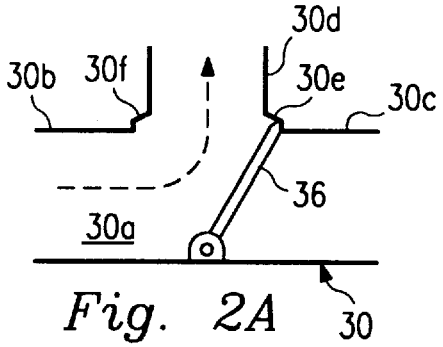
FIGS. 2A and 2B are schematic views showing different operating modes of the valve of the system of claim 1.
Figure 2B:
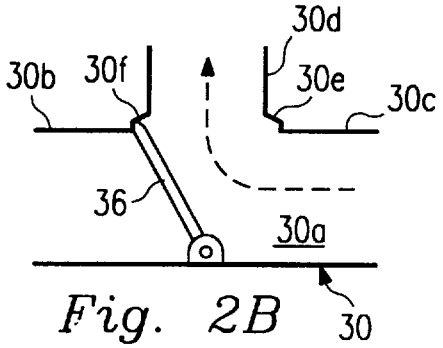

The valve member 36 is pivotal relative to the body of the connector 30 to two basic positions shown in FIGS. 2A and 2B. More particularly, the valve member 36 can be pivoted to the position shown in FIG. 2A in which its outer periphery engages in a notch, or shoulder, 30*e* formed at the junction between the connector sections 30*c* and 30*d*. In this position, the valve member 36 blocks the flow of fuel from the inlet section 30*c* into the chamber 30*a* and permits flow from the inlet section 30*b* into the latter chamber.

The valve member 36 can also be pivoted to the position shown in FIG. 2B in which its outer periphery engages in a notch, or shoulder, 30*f* formed at the junction between the sections 30*b* and 30*d*. In this position, the valve member 36 blocks the flow of fuel from the inlet section 30*b* into the chamber 30*a* while permitting flow from the inlet section 30*c* into the latter chamber.

It is understood that the valve member is designed to normally take a free floating position (not shown) between the two positions shown in FIG. 2A and in FIG. 2B, and that the force of the fuel passing through the inlet sections 30*b* or 30*c* causes the above-described pivotal movement of the valve member 36 to the two positions.

Referring to FIG. 1, a hose 38 extends from the dispensing unit 28 and has one end portion (not shown) that connects with the conduit 32 through the fixture 34. A dispensing nozzle 40 is connected to the other end of the hose 38, is conventionally designed for insertion into a customer's vehicle fuel tank (not shown), and has a manually operated valve to control the flow of the fuel into the vehicle. A product selection panel is provided on the dispensing unit 28 and has two buttons 42*a* and 42*b* that correspond to a relative low grade of fuel (as determined by its octane rating) and a relatively high grade of fuel, respectively. It is understood that a flow meter can be connected in one or more of the conduits 24, 26, and 32 (FIG. 1) to measure the flow rate of the fuel through the conduits, in a conventional manner.

In operation, the customer selects a desired grade, or octane rated, fuel at the dispensing unit 28 by pressing the appropriate button 42*a* or 42*b*, turning on a master system switch, and activating the nozzle 40 by pressing a trigger, or the like, on the nozzle, all in a conventional manner. If, for example, a low-grade fuel is selected by the customer by pressing the selection button 42*a*, the pump 20 is activated and the low-grade fuel passes from the tank 12, through the conduit 16, the pump 20, and the conduit 24 to the inlet section 30*b* of the tee connector 30 and into the chamber 30*a*. The force of this fluid flow moves the valve member 36 to the position of FIG. 2A in which it blocks, or seals, any flow of the highgrade fuel from the inlet inlet section 30*c* into the chamber 30*a*. The low-grade fuel then passes through the chamber 30*a*, the outlet section 30*d*, the conduit 32 and through the fixture 34 before entering the hose 38 and is dispensed, via the nozzle 40, into the customer's vehicle. Due to the presence of the valve member 36, there is no danger of the flow of the low-grade fuel through the chamber 30*a* siphoning or forcing any of the high-grade fuel from the connector inlet section 30*c* or the conduit 26 into the chamber 30*a*.

If a high-grade fuel is selected by the customer by pressing the selection button 42*b*, the valve member 36 moves to the position of FIG. 2B in which it seals, or blocks, the flow of the low-grade fuel from the inlet section 30*b* into the chamber 30*a* while permitting flow from the inlet section 30*c* into the latter chamber. The pump 22 is actuated and the high-grade fuel thus flows from the tank 14, through the conduit 18, the pump 22, and the conduit 26 to the inlet section 30*c* of the tee connector 30. The high-grade fuel then passes through the chamber 30*a*, the outlet section 30*d*, the conduit 32, and to the dispensing unit 28 where it passes through the fixture 34 and the hose 38 to be dispensed, via the nozzle 40, into the customer's vehicle. Due to the presence of the valve member 36, there is no danger of the above mentioned flow of the high-grade fuel through the chamber 30*a* siphoning or forcing any of the low-grade fuel from the connector inlet section 30*b* or the conduit 24 into the chamber 30*a*.

It can be appreciated that the system 10 can be designed so that additional fuels can be dispensed in the foregoing manner by simply adding additional buttons on the dispensing unit 28 and converting the valve accordingly to selectively pass one of the fuels and blocking flow of the others as described above.

Thus, according to the system and method of the present invention each of two discrete fuels can be dispensed independently without the danger of being mixed with, and contaminated by, the other fuel. Therefore, it can be assured that the octane rating of the dispensed product corresponds to that selected by the customer.

Figure 3:
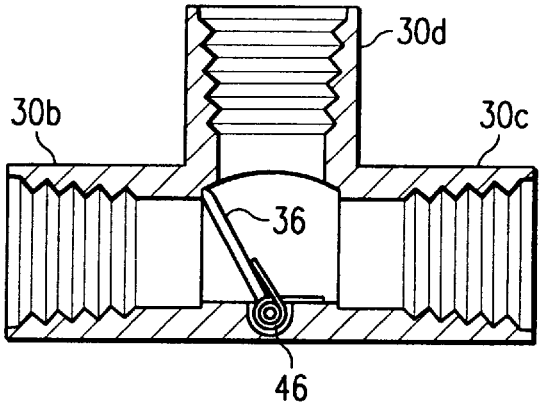
FIG. 3 is sectional view of an alternative embodiment of the valve of the system of FIGS. 1 and 2.

According to the embodiment of FIG. 3, a leaf spring 46 is provided that engages the valve member 36 and the body of the connector 30 in a manner to bias the valve member to the position shown in FIG. 2B in which it seals, or blocks, off the inlet section 30*b* and thus prevents the flow of the relatively lowgrade fuel from through the latter inlet section as described above. Thus, if the customer selects the high-grade fuel by pushing the button 42*b* as described above, the high-grade fuel would pass unimpeded through the chamber and to the nozzle 40 for dispensing, as described above. If the low-grade fuel is selected, the valve member 36 would be moved to the position shown in FIG. 2A by the force of the flowing fuel acting against the bias of the spring 44, and the low grade fuel would be dispensed in the manner described above. As in the previous embodiment, when a particular fuel is selected, the valve member 36 eliminates the danger of the flow of the selected fuel from siphoning or forcing any of the non-selected fuel into the chamber 30*a* for mixing with the selected fuel.

The spring 46 is used to bias the valve member 36 towards the position of FIG. 2B since it is more important to block any flow of the low-grade fuel when the high-grade fuel is selected, than to block any flow of the high-grade fuel when the low-grade fuel is selected.

It is understood that the system 10 can be designed to contain two fueling stations on opposing sides to service two customers at a time, each having a fuel delivery system as just described for dispensing fuel from the storage tanks 12*a* and 12*b*. As such fueling stations are identical, only one station has been described.

Several other variations can be made in the above embodiment without departing from the scope of the invention. For example, the valve 36 could be pivoted to the positions discussed above in response to an electrical signal received from the dispensing unit 28 in response to a customer's selection of the particular type of fuel to be dispensed. Also, in both of the above-disclosed embodiments, the exact location, size and lengths of the components can vary within the scope of the invention. Further, the specific valve used in the system of the present invention is not limited to the particular design shown and described above by way of example. In addition, the tee connection 30 can be replaced by a manifold or any other type of device that would permit the fuel mixing described above.

Further modifications, changes and substitutions are intended in the foregoing disclosure and in some instances some features of the invention can be employed without a corresponding use of other features. Accordingly, it is appropriate that the appended claims be construed broadly and in a manner consistent with the scope of the invention.

What is claimed is:

1. A dispensing system for two fuels having different octane ratings respectively stored in two storage tanks, the system comprising:

a flow line extending from each tank;

a chamber communicating with the flow lines for receiving each fuel from its corresponding tank;

a system for dispensing fuel, a conduit extending from the chamber to the system for passing fuel from the chamber to the system for dispensing; and a valve disposed in the chamber and movable between a first position in which it blocks the flow of one of the fuels into the chamber and permits the flow of the other fuel into the chamber, and a second position in which it blocks the flow of the other fuel into the chamber and permits the flow of the one fuel into the chamber; and a spring for normally biasing the valve to the first position, the valve responding to the flow of the one fuel for moving against the bias of the spring to the second position.

2. The system of claim 1 further comprising a pump connected in each flow line to pump the fuels from their respective tanks, through their respective flow lines, and into the chamber.

3. A method for dispensing two fuels having different octane ratings respectively stored in two storage tanks, comprising the steps of selectively passing the fuels from the storage tanks to a chamber, biasing a valve to a first position in the chamber in which it blocks the flow of one of the fuels into the chamber and permits the flow of the other fuel into the chamber, the valve responding to the flow of the one fuel for moving against the bias to a position in which it blocks the flow of the other fluid into the chamber and permits the flow of the one fuel into the chamber, and passing the fuel that passes into the chamber to a system for dispensing.

4. The method of claim 3 further comprising the step of pumping the fuels from their respective tanks, through two respective flow lines, and into the chamber.

* * * * *